US007218885B2

(12) United States Patent
Oishi et al.

(10) Patent No.: US 7,218,885 B2
(45) Date of Patent: May 15, 2007

(54) FIXING APPARATUS

(75) Inventors: Noboru Oishi, Tokyo (JP); Masahiko Shimosugi, Tokyo (JP); Shigeru Tsunoda, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 10/861,942

(22) Filed: Jun. 4, 2004

(65) Prior Publication Data

US 2004/0247352 A1 Dec. 9, 2004

(30) Foreign Application Priority Data

Jun. 6, 2003 (JP) ..... 2003-162609

(51) Int. Cl.
*G03G 15/20* (2006.01)

(52) U.S. Cl. ..... 399/333; 399/328

(58) Field of Classification Search ..... 219/216; 399/328, 329, 330, 331, 333; 430/97, 124
See application file for complete search history.

(56) References Cited

U.S. PATENT DOCUMENTS 5,070,231 A * 12/1991 Bacus et al. ..... 219/216
6,408,160 B1 * 6/2002 Saito et al. ..... 399/333

FOREIGN PATENT DOCUMENTS

| | | |
|---|---|---|
| JP | 3-75462 | 7/1991 |
| JP | 05-043097 A | 2/1993 |
| JP | 11-338224 | 12/1999 |
| JP | 2000-056601 A | 2/2000 |
| JP | 2002-072737 | 3/2002 |

* cited by examiner

*Primary Examiner*—Hoang Ngo
(74) *Attorney, Agent, or Firm*—Akin Gump Strauss Hauer & Feld LLP

(57) ABSTRACT

A fixing roller has a heat source therein and has a rubber layer on an outer periphery of a metal pipe. Hardness of the fixing roller is set to a range from 70° to 85° (ASKER C). A pressing roller is come into pressure contact with the fixing roller and a silicone foam rubber is formed on an outer periphery of a core. Hardness of the pressing roller is set to a range from 55° to 70° (ASKER C). A fixing apparatus in which a pressure necessary for color fixing is obtained, a print medium is not wrapped, and heat insulating performance of the pressing roller is obtained is provided.

8 Claims, 8 Drawing Sheets

Fig.6

OUTER DIAMETER OF FIXING ROLLER (mm)

| | 65 | 70 | 75 | 80 | 85 | 90 |
|---|---|---|---|---|---|---|
| 40 | NG | NG | NG | NG | NG | NG |
| 36 | NG | NG | NG | NG | NG | NG |
| 32 | OK | OK | OK | OK | NG | NG |
| 30 | OK | OK | OK | OK | OK | NG |
| 28 | OK | OK | OK | OK | OK | OK |
| 24 | OK | OK | OK | OK | OK | OK |

HERDNESS OF FIXING ROLLER (° )

Fig.7

OUTER DIAMETER OF FIXING ROLLER (mm)

| | 65 | 70 | 75 | 80 | 85 | 90 |
|---|---|---|---|---|---|---|
| 40 | NG | NG | NG | NG | NG | NG |
| 36 | NG | NG | NG | OK | OK | OK |
| 32 | NG | NG | OK | OK | OK | OK |
| 30 | NG | OK | OK | OK | OK | OK |
| 28 | OK | OK | OK | OK | OK | OK |
| 24 | OK | OK | OK | OK | OK | OK |

HERDNESS OF FIXING ROLLER (° )

FIXING APPARATUS

BACKGROUND OF THE INVENTION

1. Field of the Invention

The invention relates to a fixing apparatus which is used for a printer, a copying apparatus, or the like to which an electrophotographing method is applied.

2. Related Background Art

Hitherto, a fixing apparatus is constructed by a fixing roller having a heat source therein and a pressing roller which is come into pressure contact with the fixing roller. FIG. 12 shows the conventional fixing apparatus. In FIG. 12, a fixing apparatus 1 is used for a monochromatic printer and has a fixing roller 2 and a pressing roller 3. The fixing roller 2 is constructed in such a manner that a fluorine mold releasing layer 5 for releasing toner is formed on a surface of a metal pipe 4 such as aluminum or iron having excellent thermal conductivity, and a heat source 6 is provided in the fixing roller. The pressing roller 3 is come into pressure contact with the fixing roller 2 by a pressing spring 7 and is rotated in association with the rotation of the fixing roller 2. A core shaft 9 is coated with a foam rubber layer 8 having excellent heat insulating performance, thereby forming the pressing roller 3.

When the pressing roller 3 is come into pressure contact with the fixing roller 2, a nip layer 10 is formed. When a print medium 12 which holds unfixed toner 11 passes through the nip layer 10, the unfixed toner 11 is fixed onto the print medium 12. Since the nip layer 10 is in such a shape that a portion on the side of the pressing roller 3 is dented, after the print medium 12 nipped by the nip layer 10 goes out of the nip layer 10, it is conveyed along an outer peripheral surface of the fixing roller 2 and can be easily wrapped around the fixing roller 2. Therefore, a separating nail 13 is provided on the surface of the fixing roller 2 in a contact state, thereby peeling off the print medium 12 from the fixing roller 2.

However, if the separating nail is in contact with the surface of the fixing roller, the surface of the fixing roller is damaged and an adverse influence is exerted on picture quality. To avoid such a problem, fundamentally, there is a case where no separating nail is provided in the color printer in which high picture quality is required in particular.

A fixing apparatus having no separating nail has been disclosed in, for example, JP-A-2000-56601. According to the technique disclosed in this Official Gazette, hardness of the pressing roller is set to be higher than that of the fixing roller, thereby forming such a nip shape that the pressing roller bites the fixing roller, so that a print medium is curved toward the pressing roller side.

However, in the above conventional apparatus, if the hardness of the fixing roller is reduced and the hardness of the pressing roller is simply increased, the nip width inevitably becomes narrow and an amount of heat necessary for fixing cannot be supplied to the toner and the sufficient pressure necessary for fixing cannot be obtained. Particularly, in the fixing apparatus which is used for the color printer, since a high pressure is necessary and a toner portion of a single layer and a toner portion of multilayers exist, the pressure cannot be uniformly applied to those toner portions. If the hardness of the pressing roller made of a foam material is increased, physical properties of the pressing roller have to be set to physical properties close to those of a solid rubber by further reducing the expansion ratio of the foam material, so that high heat insulating performance cannot be obtained.

SUMMARY OF THE INVENTION

It is an object of the invention to provide a fixing apparatus to which a pressure and an amount of heat necessary for fixing toner, particularly, fixing color toner are given and a print medium is not wrapped.

According to the present invention, there is provided a fixing apparatus comprising a fixing roller which has a heat source and has an elastic layer on an outer periphery and a pressing roller which applies a pressure to the fixing roller and has an elastic layer on an outer periphery, in which a pressure is applied to a print medium holding unfixed toner by the fixing roller and the pressing roller, thereby fixing the unfixed toner onto the print medium, wherein hardness of the fixing roller is set to a range from 70° to 85° (ASKER C), the elastic layer of the pressing roller is made of a foam material, and hardness of the pressing roller is set to a range from 55° to 70° (ASKER C).

In the fixing apparatus, an outer diameter of the fixing roller may be equal to 30 mm or less. In this case, in the pressing roller, the hardness of a center portion in an axial direction is smallest and, the nearer a position approaches both end portions, the more the hardness increases.

Further, in the fixing apparatus, a film-shaped belt for fixing may be wrapped around the fixing roller and the pressing roller may be come into pressure contact with the fixing roller through the belt.

The above and other objects and features of the present invention will become apparent from the following detailed description and the appended claims with reference to the accompanying drawings.

BRIEF DESCRIPTION OF THE DRAWINGS

FIG. 6 is a table showing results of examination of peeling performance of a print medium;

FIG. 7 is a table showing results of examination of occurrence of a cold offset;

DETAILED DESCRIPTION OF THE PREFERRED EMBODIMENTS

Figure 1:
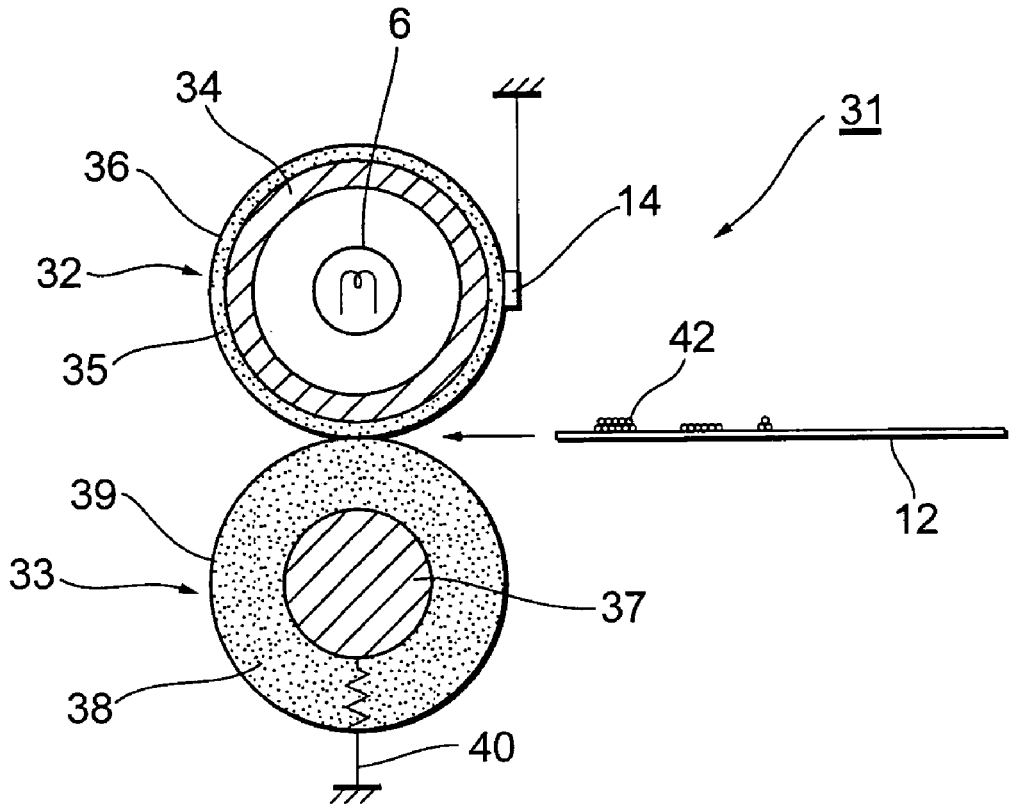
FIG. 1 is a cross sectional view showing a fixing apparatus according to the first embodiment of the invention.

Embodiments of the invention will be described hereinbelow with reference to the drawings. Component elements which are common in the diagrams are designated by the same reference numerals. FIG. 1 is a cross sectional view showing a fixing apparatus according to the first embodiment of the invention.

In FIG. 1, a fixing apparatus 31 of the first embodiment has a fixing roller 32 and a pressing roller 33. The fixing roller 32 is constructed in such a manner that a metal pipe 34 made of an aluminum-based pipe whose thickness is equal to 1.8 mm as a raw material is used for a core, a silicone rubber layer 35 whose thickness is equal to 1.2 mm is formed on an outer periphery of the core, and further, an outer periphery of the silicone rubber layer 35 is coated with a fluorine mold releasing layer 36. A thickness of mold releasing layer 36 is equal to 30 μm. An outer diameter of the fixing roller 32 is equal to 28 mm and hardness of its surface is equal to 75° (hardness specified in the standard 0101 of Japan Rubber Association, that is, 75 degree as ASKER C). The heat source 6 is provided in the metal pipe 34. A thermistor 14 to detect a temperature is arranged on the outer periphery of the fixing roller 32.

The pressing roller 33 is constructed in such a manner that a silicone foam rubber 38 whose thickness is equal to 7 mm is formed on an outer periphery of a core 37 made of iron and, further, an outer periphery of the silicone foam rubber 38 is coated with a fluorine mold releasing layer 39. A thickness of mold releasing layer 39 is equal to 50 μm. An outer diameter of the pressing roller 33 is equal to 28 mm and hardness of its surface is equal to 65° (ASKER C). Pressing springs 40 are attached to both end portions of the pressing roller 33. The pressing springs 40 press the pressing roller 33 against the fixing roller 32 with a pressure of 10 kgf, respectively.

Figure 2:
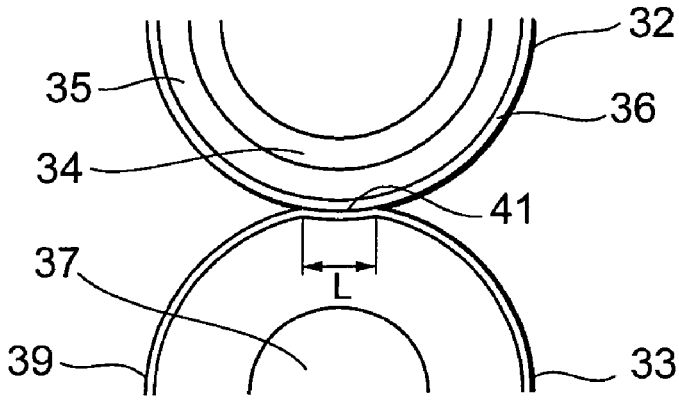
FIG. 2 is an enlarged diagram showing a nip portion in the first embodiment.

FIG. 2 is an enlarged diagram showing a nip portion in the first embodiment. As shown in FIG. 2, a nip width L of a nip portion 41 is set to 6 mm. The nip portion 41 has such a shape that the fixing roller 32 bites the pressing roller 33 because hardness of the surface of the fixing roller 32 is larger than that of the surface of the pressing roller 33.

The fixing operation will now be described. In FIG. 1, when a control unit of a printer (not shown) receives print data, the heat source 6 comprising a halogen heater is turned on and starts to overheat. When the print medium 12 on which unfixed toner 42 has been transferred is conveyed in the direction shown by an arrow, the print medium 12 enters the nip portion 41 and the unfixed toner 42 is fixed onto the print medium 12. The print medium 12 which went out of the nip portion 41 is ejected to the outside of the printer through an ejecting port (not shown). By using the fixing apparatus of the embodiment, full-color printing can be performed at a speed of 12 ppm to plain paper of the A4 size which is fed in a portrait direction.

Figure 3:
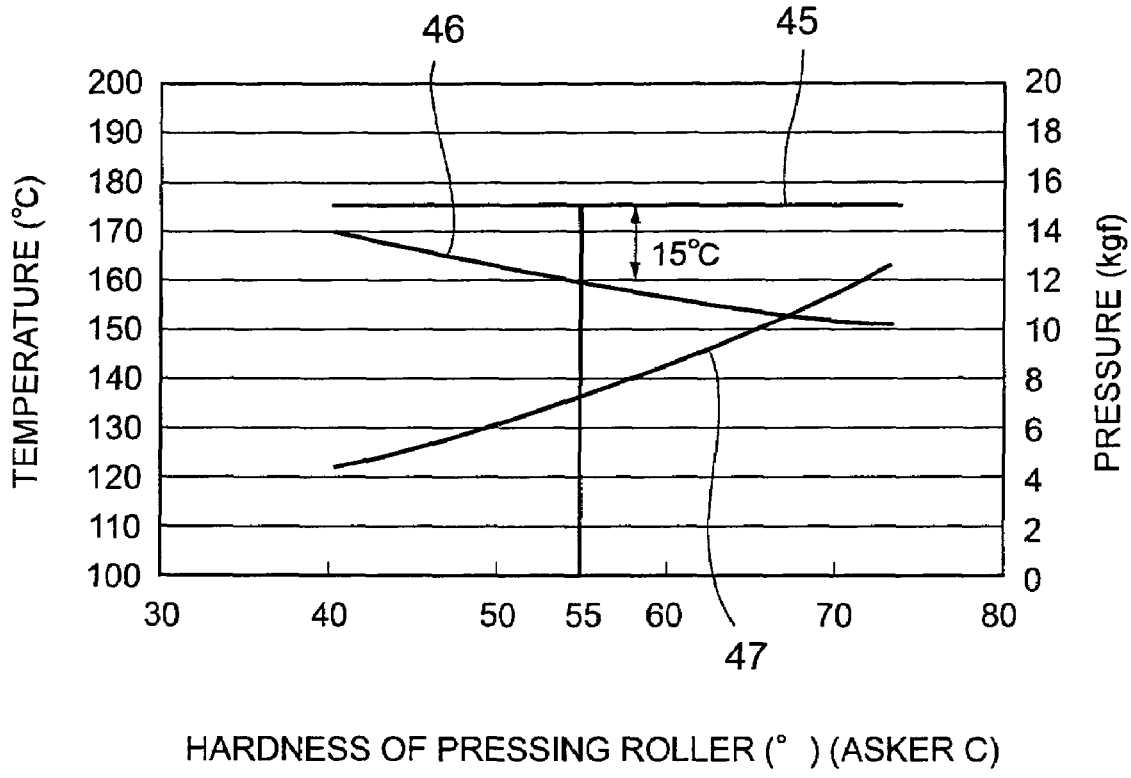
FIG. 3 is an explanatory diagram showing a preferable fixing temperature range.

FIG. 3 is an explanatory diagram showing a preferable fixing temperature range. In FIG. 3, an axis of abscissa shows hardness (ASKER C) of the pressing roller, an axis of ordinate on the left side indicates a temperature of the fixing roller, and an axis of ordinate on the right side indicates a pressure which is applied to the fixing roller by the pressing roller. A line 45 shown in the diagram denotes an area where the hot offset occurs. A portion over the line 45 shows the hot offset occurring area. A line 46 denotes an area where the cold offset occurs. A portion under the line 46 shows the cold offset occurring area. Therefore, an area sandwiched between those two lines 45 and 46 corresponds to the preferable fixing temperature range. A line 47 denotes a change in pressure.

When the hardness of the pressing roller is raised, the pressure has to be increased as shown by the line 47 in order to keep the nip width constant. When the pressure is increased, although an upper limit temperature of the cold offset occurring area decreases as shown by the line 46, a lower limit temperature of the hot offset occurring area is constant as shown by the line 45. This is because although the cold offset depends on a junction force of the toner and the print medium, the junction force largely depends on the pressure, and when the pressure is small, the toner does not penetrate into the print medium unless the fixing temperature is raised, however, when the pressure is large, the toner penetrates into the print medium even at a low temperature. With respect to the hot offset, it is not influenced by the pressure because it is such a phenomenon that a cohesive force of the toner is reduced by the heat and, when it is smaller than the junction force of the toner and the surface of the fixing roller, the toner is transferred onto the surface of the fixing roller.

It is difficult to keep the temperature of the fixing roller constant when the print medium is passed, the heat is lost by the print medium due to the paper passage and the fixing temperature decreases. Such a phenomenon is what is called a temperature ripple. There are many cases where, when the temperature of the fixing roller is elevated to a set temperature at the start of the printing, even after the temperature of the fixing roller reaches the set temperature, it continues to rise and overshoot occurs. Although it is possible to make control so as to minimize the occurrence of such temperature ripple and overshoot, it is difficult to completely eliminate them. However, when the preferable fixing temperature range shown in FIG. 3 is wide, even if the temperature ripple or the overshoot occurs, it becomes easy to make control so that the fixing temperature lies within the preferable fixing temperature range.

Figure 4:
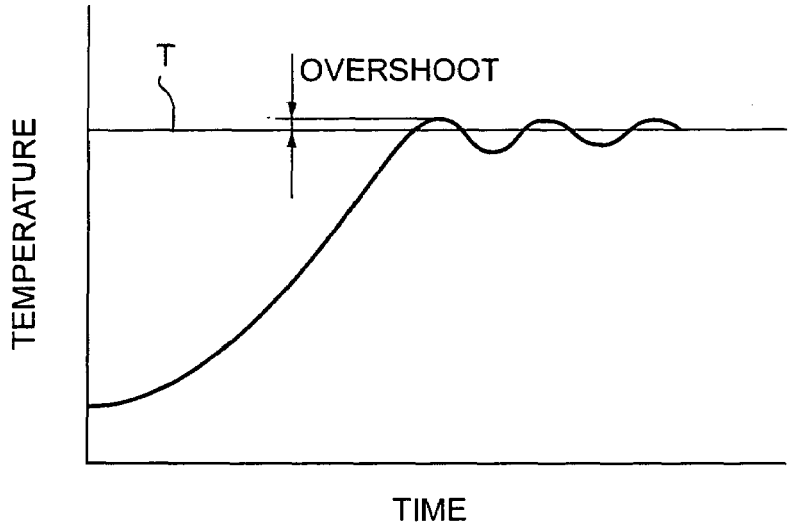
FIG. 4 is a graph showing a change in surface temperature of a fixing roller in a range from a temperature increase to a print start.

FIG. 4 is a graph showing a change in surface temperature of the fixing roller in a range from the temperature increase to the print start in the fixing apparatus in the embodiment. In FIG. 4, the overshoot at a set temperature T is equal to 5° C. and the temperature ripple at the time of the paper passage is equal to 10° C. Therefore, it will be understood that if the preferable fixing temperature range shown in FIG. 3 is equal to or higher than 15° C., no defective fixing occurs. From FIG. 3, it is preferable to set the hardness of the pressing roller to 55° (ASKER C) or higher in order to set the preferable fixing temperature range to 15° C. or higher.

Figure 5:
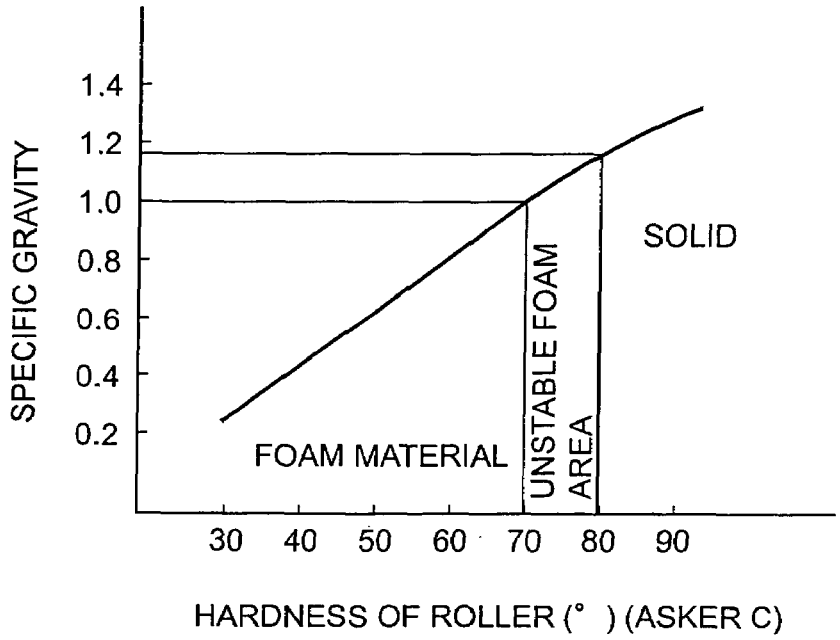
FIG. 5 is a graph showing a relation between hardness of a pressing roller and a specific gravity.

FIG. 5 is a graph showing a relation between the hardness of the pressing roller made of a foam rubber and the specific gravity. In FIG. 5, the roller is held as a foam material until the hardness of the foam rubber is equal to 70° (ASKER C), and it enters an unstable foam state in a range from 70° (ASKER C) to 80° (ASKER C). When the hardness rises to a value over 80°, the roller becomes a solid rubber. Although the specific gravity rises with an increase in hardness of the pressing roller, when the hardness is equal to 80° (ASKER C) or higher, an increase rate of the specific gravity decreases. It means that there is a correlation between the specific gravity of the pressing roller and the expansion ratio. In other words, when the expansion ratio is reduced, the pressing roller approaches the solid rubber unlimitedly. The nearer the roller approaches the solid rubber, the more the heat insulating performance of the pressing roller is lost. When the hardness is equal to 70° (ASKER C) or higher, the expansion ratio decreases and it is difficult to keep a uniform foam state upon manufacturing. Therefore, an upper limit of the practical hardness of the pressing roller is set to 70° (ASKER C).

Since a lower limit of the hardness of the pressing roller described in FIG. 3 is equal to 55° (ASKER C) and the upper limit is equal to 70° (ASKER C) as described above, a range of the hardness of the pressing roller where the preferable fixing temperature range can be held and the heat insulating performance can be assured is a range from 55° (ASKER C) to 70° (ASKER C).

A method of determining the proper hardness and outer diameter of the fixing roller will now be described. In order to enable the print medium to be peeled off by the conventional fixing roller, it is necessary to set the hardness of the pressing roller to 80° (ASKER C) or higher and, for this purpose, the solid rubber has to be used. However, the fixing roller by which the print medium can be peeled off even when the pressing roller is made of a foam material of low hardness has the following construction.

FIG. 6 shows results of examination of peeling performance of the print medium at the time when the hardness and outer diameter of the fixing roller are changed and printing is executed. In FIG. 6, setting conditions of the pressing roller are set as follows. The outer diameter of the pressing roller is set to 28 mm and the hardness is set to 55° (ASKER C) as the worst condition in the range from 55° (ASKER C) to 70° (ASKER C) with respect to points of wrapping of the print medium and the pressure. The pressure is adjusted in each condition so that the nip width is equal to 6 mm. The nip width of 6 mm is a value in which paint printing of multilayer toner can be fixed at a print speed of 12 ppm and the fixing temperature of 170° C. The fixing temperature in FIG. 6 is set to 175° C. by presuming 5° C. of the overshoot. A print pattern is printed as a paint pattern (whole-surface print pattern) in which the toner of three colors of yellow, magenta, and cyan is overlaid.

In FIG. 6, the case where the wrapping of the print medium does not occur is shown by "OK" and the case where the wrapping of the print medium occurred is shown by "NG". As shown in the diagram, the range of the hardness of the fixing roller where there is no wrapping of the print medium is magnified to a wide range as the outer diameter of the roller is small. When the outer diameter is equal to or less than 28 mm, no wrapping occurs in all hardness values which were examined. The reasons why no wrapping occurs even at the high hardness when the outer diameter of the fixing roller is small are as follows. When the outer diameter of the fixing roller decreases, a curvature of the nip portion increases, a deflection angle of the print medium which passes through the nip portion increases, a restoring force due to rigidity of the print medium increases consequently, and this restoring force becomes a peeling force from the fixing roller.

FIG. 7 shows results of examination of the occurrence of the cold offset at the time when the hardness and outer diameter of the fixing roller are changed and printing is executed. In FIG. 7, setting conditions of the pressing roller are set as follows in a manner similar to the case of FIG. 6. The outer diameter of the pressing roller is set to 28 mm and the hardness is set to 55° (ASKER C) as the worst condition in the range from 55° (ASKER C) to 70° (ASKER C) with respect to points of wrapping of the print medium and the pressure. The pressure is adjusted in each condition so that the nip width is equal to 6 mm. The fixing temperature in FIG. 7 is set to 160° C. by presuming 15° C. of the temperature ripple. The print pattern is printed as a paint pattern (whole-surface print pattern) in which the toner of three colors of yellow, magenta, and cyan is overlaid.

In FIG. 7, the case where the cold offset does not occur is shown by "OK" and the case where the cold offset occurred is shown by "NG". As shown in the diagram, the range of the hardness of the fixing roller where no cold offset occurs is magnified to a wide range as the outer diameter of the roller is small. When the outer diameter of the roller is small, a sufficient fixing force is obtained even by the fixing roller of low hardness. This is because since the pressure is adjusted so as to keep the nip width constant, when the outer diameter of the fixing roller decreases, that is, when the curvature of the nip portion increases, a maximum value of pressure distribution in the nip portion increases and the pressure necessary for fixing is obtained.

Figure 8A:
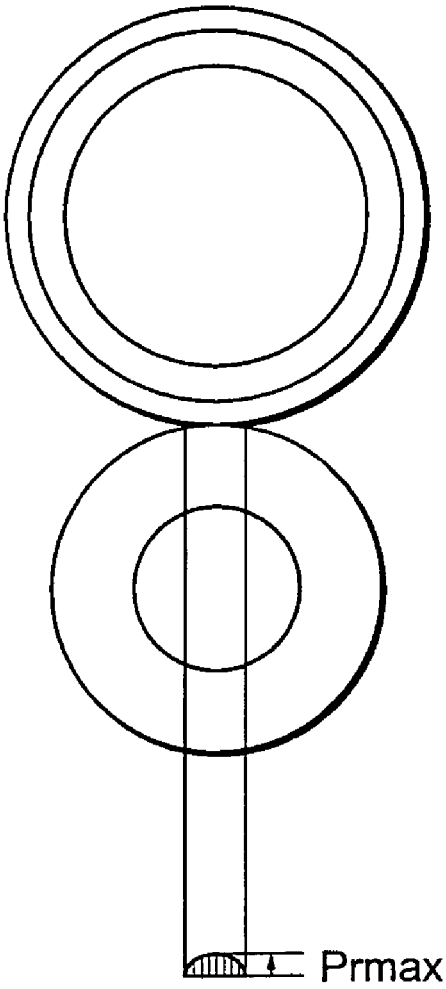
FIGS. 8A and 8B are explanatory diagrams each showing pressure distribution of the nip portion.
Figure 8B:
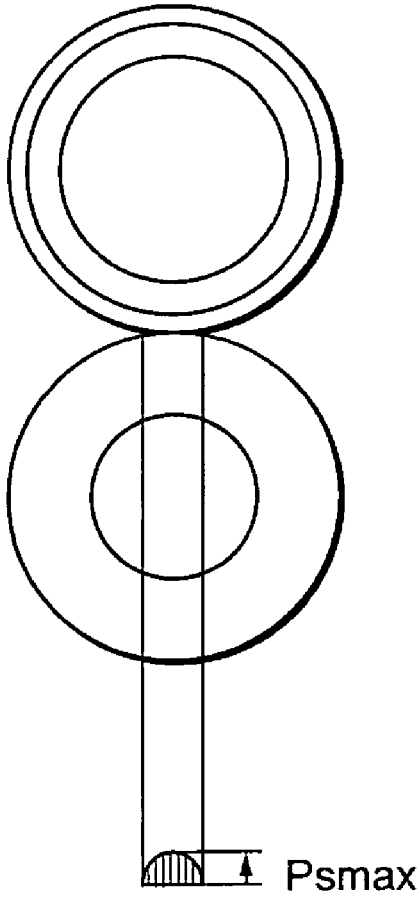

FIGS. 8A and 8B are explanatory diagrams each showing the pressure distribution of the nip portion. FIG. 8A shows the pressure distribution of the nip portion of the fixing roller having a large outer diameter and FIG. 8B shows the pressure distribution of the nip portion of the fixing roller having a small outer diameter. The smaller the outer diameter is, the larger the curvature is. However, in FIGS. 8A and 8B, the nip widths are set to the same value. If the nip widths are set to the same value, the larger the curvature is, the more the maximum pressure increases. That is, a maximum pressure Psmax in FIG. 8B is larger than a maximum pressure Prmax in FIG. 8A (Psmax>Prmax).

From the results shown in FIGS. 6 and 7, it has been found that when the outer diameter of the fixing roller is, the wrapping of the print medium and the cold offset do not occur. However, when considering that there is an inconvenience such as deflection or the like of the fixing roller by pressing the fixing roller by both end portions, the accumulated number of rotating times up to the specific number of print copies is wastefully increased, and the life becomes short, it is better to set the outer diameter of the fixing roller to be as large as possible. Therefore, when the range of the necessary hardness of the fixing roller is obtained, it is preferable to set the range to 15° (ASKER C) because of the following reasons. That is, about 8° (ASKER C) is necessary as a range of the hardness in consideration of a variation upon manufacturing such as variation in rubber material, dimensions of the fixing roller, or the like. The hardness decreases by about 5° (ASKER C) by the aging change during use of the roller. In consideration of all of the above-mentioned conditions, the necessary hardness range is set to 15° (ASKER C) while further leaving a margin.

From the results shown in FIGS. 6 and 7, the fixing rollers which show the good results in the hardness range of 15° (ASKER C) correspond to the rollers whose outer diameters are equal to 30 mm or less. The hardness of the fixing roller at this time lies within a range from 70° (ASKER C) to 85° (ASKER C) (this range is shown by a region surrounded by a bold line).

As described above, according to the first embodiment, the silicone foam rubber having excellent heat insulating performance is used for a pressing roller 33, its hardness is set to a high hardness range of 55° to 70° (ASKER C) where the heat insulating performance can be maintained, the diameter of the fixing roller is set to 30 mm or less, and its hardness is set to a range of 70° to 85° (ASKER C). Therefore, the pressure necessary for color fixing is obtained and the wrapping of the print medium can be eliminated. The fixing apparatus of a low price and high quality can be provided.

Figure 9:
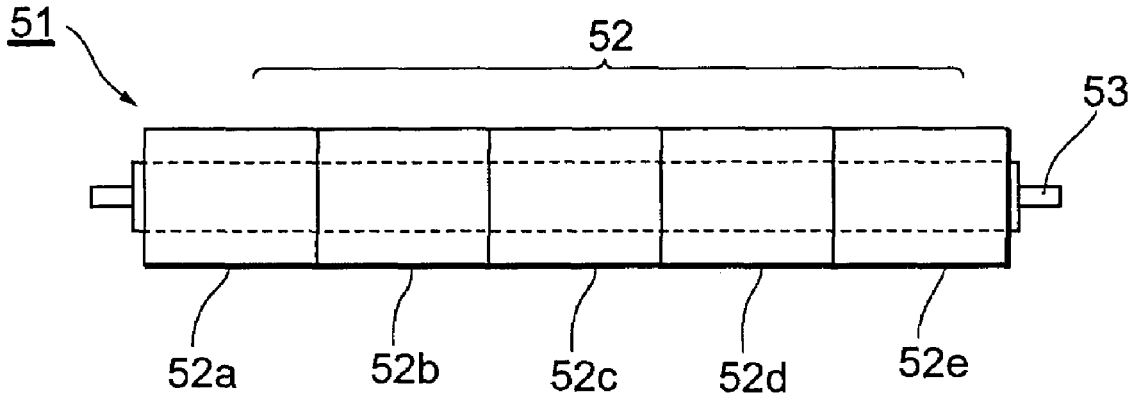
FIG. 9 is a front view showing a pressing roller according to the second embodiment.

The second embodiment of the invention will now be described. FIG. 9 is a front view showing a pressing roller of the second embodiment. In FIG. 9, in a pressing roller 51 in the second embodiment, a silicone foam rubber layer 52 is divided into five foam rubber layers 52*a* to 52*e* in the longitudinal direction (axial direction) and their hardness values are different. The hardness of the center foam rubber layer 52*c* is the lowest and set to 55° (ASKER C). The hardness of each of the foam rubber layers 52*b* and 52*d* adjacent to the center foam rubber layer 52*c* is set to 60° (ASKER C). The hardness values are set in such a manner that the hardness of each of the foam rubber layers 52*a* and 52*e* in both end portions is set to 65° (ASKER C). That is, the hardness of the center foam rubber layer 52*c* is the lowest and the nearer the rubber layer approaches both end portions, the higher the hardness of the foam rubber layer is. The other construction is similar to that in the first embodiment.

A core 53 of the pressing roller 51 is deflected since pressures are applied thereto in both end portions, so that a difference occurs between the nip width in the center portion and that in each of both end portions. When the difference between the nip widths occurs, a variation in fixing performance occurs.

Figure 10:
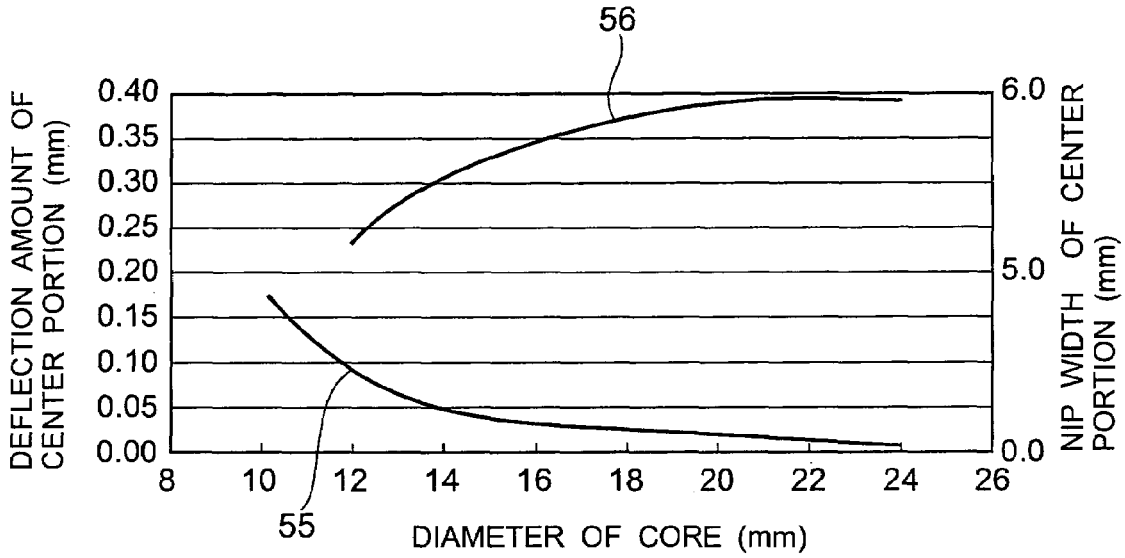
FIG. 10 is a graph showing changes in deflection amount and nip width of the pressing roller.

FIG. 10 is a graph showing a change in deflection amount and nip width depending on the diameter of the core of the pressing roller. In FIG. 10, an axis of abscissa indicates the core diameter, an axis of ordinate on the left side shows a deflection amount, and an axis of ordinate on the right side shows the nip width of the center portion. A line 55 indicates the deflection amount and a line 56 indicates the nip width. FIG. 10 shows the results obtained by measuring the pressing roller in the first embodiment. The nip widths of both end portions of the pressing roller are set to 6.0 mm.

Figure 11:
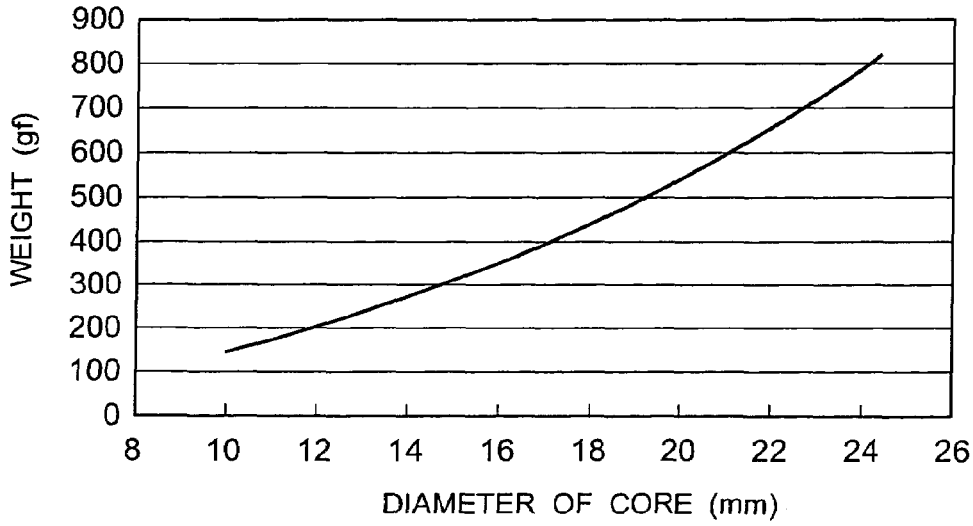
FIG. 11 is a graph showing a relation between a diameter and a weight of a core.
Figure 12:
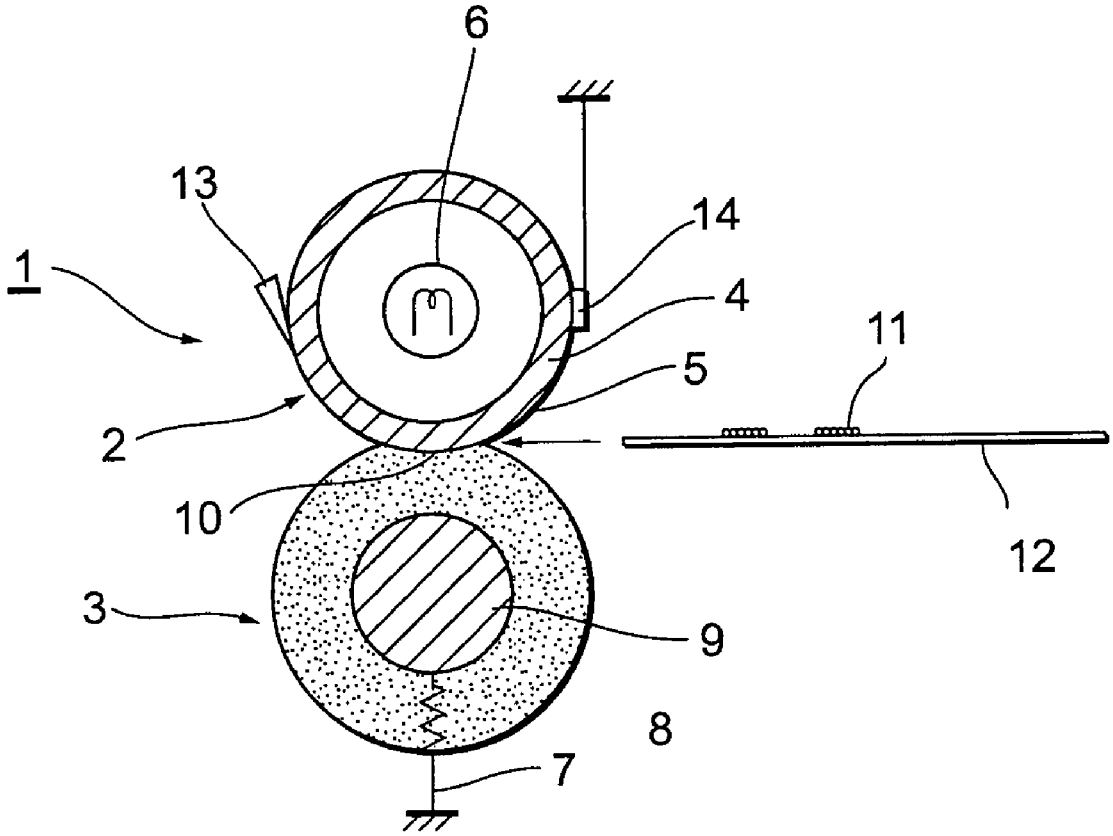
Fig.12 PRIOR ART
FIG. 12 is a cross sectional view showing a conventional fixing apparatus.

As shown in the diagram, the smaller the diameter of the core is, the larger the deflection amount of the center portion of the pressing roller is. The smaller the diameter of the core is, the smaller the nip width of the center portion is. Since the diameter of the core of the pressing roller used in the first embodiment is equal to 14.0 mm, the nip width of the center portion in this case is equal to about 5.6 mm. Thus, a difference of about 9% occurs between the nip width of about 5.6 mm of the center portion and that of 6.0 mm in both end portions. When the nip width decreases, an amount of heat which is given to the print medium decreases, so that the variation in fixing performance occurs. Although it is preferable to increase the diameter of the core in order to reduce the deflection amount, if the core is thickened, as shown in FIG. 11, a weight of the core increases and a thickness of foam rubber layer is relatively thinned. When the foam rubber layer becomes thin, a problem on the heat insulating characteristics occurs as mentioned above. FIG. 11 is a graph showing a relation between the diameter and the weight of the core.

In the second embodiment, the hardness of the foam rubber layer 52 of the pressing roller 51 is set so as to gradually become low as the position approaches from both end portions to the center portion. If the hardness is high, a reactive force in the case of pressing increases. When the hardness is reduced, the reactive force decreases in association with it. Therefore, by raising the hardness of both end portions of the pressing roller 51 and reducing the hardness of the center portion, the reactive force of the center portion upon pressing is smaller than that of each of both end portions, so that the deflection amount of the center portion is smaller than that of each of both end portions. Since the hardness of the center portion is low, the nip width is assured. Consequently, the nip width becomes almost uniform in the axial direction of the pressing roller 51.

In the embodiment, the hardness of the foam rubber layer 52*c* of the center portion of the pressing roller 51 is set to 55° (ASKER C) and the hardness of each of the foam rubber layers 52*a* and 52*e* of both end portions is set to 65° (ASKER C). However, naturally, the values of the hardness are not limited to those values but can be set to other values so long as they satisfy such a condition that the hardness rises gradually as the position approaches from the center portion to both end portions. However, it is necessary that the hardness value of the whole pressing roller 51 lies within the range of 55° to 70° (ASKER C) mentioned in the first embodiment.

As mentioned above, according to the second embodiment, since the hardness rises gradually as the position approaches from the center portion of the pressing roller to both end portions, the nip width of the pressing roller becomes uniform in the axial direction. Therefore, there is such an effect that the variation in fixing performance does not occur and the fixing apparatus of high quality can be obtained.

The invention can be applied to a fixing apparatus of such a structure that a film-shaped endless belt for fixing is wrapped around the fixing roller.

As described in detail above, according to the invention, the foam material having excellent heat insulating performance is used for a pressing roller, its hardness is set to a high hardness range of 55° to 70° (ASKER C) where the heat insulating performance can be maintained, and the hardness of the fixing roller is set to a range of 70° to 85° (ASKER C). Therefore, the pressure necessary for color fixing is obtained and the wrapping of the print medium can be eliminated. The fixing apparatus of a low price and high quality can be provided.

The present invention is not limited to the foregoing embodiments but many modifications and variations are possible within the spirit and scope of the appended claims of the invention.

What is claimed is:

1. A fixing apparatus comprising a heat fixing roller which has a heat source for producing heat to fix toner on a print medium; and a pressing roller providing a pressure to the heat fixing roller;

wherein the heat fixing roller has a releasing layer on its outer periphery, and an elastic layer provided inside the releasing layer; the pressing roller has a releasing layer on its outer periphery and a foam material layer inside the releasing layer, and wherein hardness of the elastic layer of the heat fixing roller is set to a range from 70° to 85° (ASKER C); and hardness of the foam material layer of the pressing roller is set to a range from 55° to 70° (ASKER C).

2. The fixing apparatus according to claim 1, wherein an outer diameter of said heat fixing roller is equal to 30 mm or less.

3. The fixing apparatus according to claim 1, wherein said pressing roller has an axial direction, a center portion and two end portions aligned along the axial direction; and wherein the hardness of the pressing roller increases from the center portion to each of said end portions.

4. The fixing apparatus according to claim 1, wherein a film-shaped belt for fixing is wrapped around said heat fixing roller and said pressing roller is in pressure contact with said heat fixing roller through said belt.

5. The fixing apparatus according to claim 1, wherein said elastic layer of said heat fixing roller is made of silicone rubber.

6. The fixing apparatus according to claim 1, wherein said foam material layer of said pressing roller is made of silicone foam rubber.

7. The fixing apparatus according to claim 1, wherein the releasing layer of the heat fixing roller is 30 μm and thickness of the releasing layer of the pressing roller is 50 μm.

8. The fixing apparatus according to claim 1, wherein the pressing roller is divided into five parts along an axial direction of the pressing roller: a center part, two end parts, and two parts between the central part and the respective end parts, wherein hardness of the central part is 55° (ASKER C), hardness of the end parts is 65° (ASKER C), and hardness of the parts between the central parts and the respective end parts is 60° (ASKER C).

* * * * *